US005549376A

United States Patent [19]

Domenig

[11] Patent Number: 5,549,376

[45] Date of Patent: Aug. 27, 1996

[54] SNAP-IN BRACKET FOR MOUNTING A DRAWER GUIDE IN A DESK OR CABINET

[75] Inventor: Georg Domenig, Kernersville, N.C.

[73] Assignee: Grass America, Inc., Kernersville, N.C.

[21] Appl. No.: 287,764

[22] Filed: Aug. 9, 1994

[51] Int. Cl.[6] ..... A47B 88/00

[52] U.S. Cl. ..... 312/334.5; 312/334.7

[58] Field of Search ..... 312/334.27, 334.5, 312/334.12, 334.7, 334.21, 334.42, 334.4, 334.1; 248/223.4, 225.1, 221.4, 221.3, 223.41, 225.11, 222.12, 222.11, 316.7, 314; 384/22

[56] References Cited

U.S. PATENT DOCUMENTS

| | | | |
|---|---|---|---|
| 1,042,898 | 10/1912 | Eastman | 248/316.7 |
| 3,160,280 | 12/1964 | Burch | 248/314 X |
| 3,809,799 | 5/1974 | Taylor | 248/316.7 X |
| 4,037,897 | 7/1977 | Siggia | 312/334.4 |
| 4,112,550 | 9/1978 | DeWitt et al. | 248/223.41 X |
| 4,141,525 | 2/1979 | Miller | 312/334.4 X |
| 4,215,840 | 8/1980 | Babberl | 248/221.4 |
| 4,244,546 | 11/1981 | Mertes et al. | 312/334.27 X |
| 4,278,309 | 7/1981 | Dreiling | 312/334.27 X |
| 4,387,942 | 6/1983 | Lense | 312/334.41 X |
| 4,500,943 | 2/1985 | Greene | 248/222.11 X |
| 4,612,603 | 9/1986 | Cook | 248/222.12 |
| 4,810,045 | 3/1989 | Lautenschlager | 312/334.5 X |
| 5,039,181 | 8/1991 | Lautenschlager | 312/334.7 |
| 5,257,861 | 11/1993 | Domenig et al. | 312/334.5 |
| 5,359,752 | 11/1994 | Domenig | 312/334.5 X |
| 5,387,033 | 2/1995 | Domenig | 312/334.5 |

*Primary Examiner*—Peter M. Cuomo
*Assistant Examiner*—Janet M. Wilkens
*Attorney, Agent, or Firm*—Petree Stockton, LLP

[57] ABSTRACT

A snap-in mounting bracket for use in a desk or cabinet and with a drawer guide having a tongue portion includes a base carrying a pair of opposing retaining flanges resiliently connected to the base and configured to cooperatively receive a drawer guide tongue portion in snap-in engagement allowing lateral adjustment of the drawer guide with respect to the desk or cabinet. At least one support wall and preferably a pair of opposing support walls rigidly connected to the bracket base cooperatively support the engaged drawer guide tongue portion. One of the support walls may be provided with a notch for engaging the drawer guide to prevent lateral movement of the drawer guide. The bracket is supported on the desk or cabinet by fasteners such as fastening screws received through openings formed in the base and into the desk or cabinet.

6 Claims, 2 Drawing Sheets

SNAP-IN BRACKET FOR MOUNTING A DRAWER GUIDE IN A DESK OR CABINET

BACKGROUND OF THE INVENTION

1. Field of the Invention

The present invention relates to desk or cabinet drawer guide mounting brackets and more particularly to a new and improved mounting bracket used in connection with a drawer guide having a tongue portion, the bracket having a base with opposing retaining flanges resiliently connected to the base to cooperatively receive the drawer guide tongue portion in snap-in engagement of the drawer guide.

2. Description of the Prior Art

Various types of mounting brackets for desk and cabinet drawers have been used in the furniture industry for many years. Generally, such brackets are not precisely designed or engineered to achieve stability, long wear or efficient operation. Such brackets have adjustable elements, usually formed directly in the bracket body, making the bracket difficult to adjust, insufficient to achieve drawer stability with respect to the desk or cabinet, and quick to deteriorate.

There is a current need to provide more precisely designed and manufactured mounting brackets which operate with greater efficiency and adjustability while retaining the costs associated with the design and manufacture of such devices within the same range as presently experienced with conventional brackets.

Moreover, while improved brackets of the type disclosed in U.S. Pat. No. 5,257,861 partially address this need, the usefulness of such brackets is limited in that they are designed to be attached to the tongue portion of the drawer guide before installing the bracket and drawer guide in the desk or cabinet. The design of such brackets makes it is necessary to slide the leading end of the tongue portion through an end opening of the bracket which is defined between top and bottom portions of the bracket, and at the same time to slide the tongue portion over a stop upstanding from the bracket base and spaced from the bracket end opening. If the bracket is installed in the desk or cabinet before attaching the drawer guide to the bracket, the confined space within the desk or cabinet makes it impractical, if not impossible, to attach the drawer guide tongue portion to the installed bracket.

The present invention addresses this need and provides a bracket which can be installed in a desk or cabinet for receiving the drawer guide tongue portion in snap-in engagement and which provides for either lateral adjustment of the drawer guide or fixed positioning of the drawer guide relative to the desk or cabinet.

SUMMARY OF THE INVENTION

The general purpose of the present invention, which will be described subsequently in greater detail, is to provide a new and improved snap-in mounting bracket to be used on a desk or cabinet and with a drawer guide having a tongue portion, that has all, and more, of the advantages of prior art brackets and none of the disadvantages.

To attain this purpose, representative embodiments of the present invention are illustrated in the drawings. The bracket of the present invention makes use of a base having spaced from each other a pair of retaining flanges which are configured to cooperatively receive the drawer guide tongue portion in snap-in engagement for lateral adjustment of the drawer guide with respect to its position within the desk or cabinet and which permits only lateral movement of the drawer guide tongue portion relative to the bracket.

Each of the retaining flanges is resiliently connected to the base and each has a projection for receiving and engaging the drawer guide tongue portion. The retaining flange projections each have a sliding surface and an associated engaging surface, and the respective sliding surfaces slidingly receive the drawer guide tongue portion to a snap-in engaged position of the drawer guide tongue portion between the base and the respective engaging surfaces. In order to install the tongue portion of the drawer guide, the tongue portion is pressed flat against the respective sliding surfaces, which are inclined relative to the base to deflect the retaining flanges apart, until the tongue portion clears the sliding surfaces and the retaining flanges snap back to their original upstanding position.

The engaging surfaces of each of the retaining flange projections and the base define between them an opening which may be smaller than the thickness of the drawer guide tongue portion to cooperatively receive and engage the tongue portion and frictionally maintain the tongue portion for lateral adjustment.

At least one support wall and preferably a pair of opposing support walls rigidly connected to the base and disposed between the retaining flanges and the rear of the base cooperatively support the engaged drawer guide tongue portion. Additional support for the tongue portion of the drawer guide may be provided by at least one support wall and preferably a second pair of opposing support walls rigidly connected to the base and disposed between the retaining flanges and the front of the base cooperatively supporting the engaged drawer guide tongue portion. Lateral movement of the engaged drawer guide tongue portion may be limited by a rear wall formed at the rear of the base.

Alternatively, one of the support walls disposed between the retaining flanges and the rear of the base may be provided with a notch for receiving an end portion of a flange of the drawer guide, in which case, when the drawer guide tongue portion is installed in a snap-in engaged position between the base and the respective engaging surfaces of the retaining flanges, the end portion of the flange of the drawer guide is received in the notch, and the drawer guide is locked in position against any lateral movememt of the drawer guide tongue portion.

The bracket is supported on the desk or cabinet by fasteners such as fastening screws inserted through openings formed in the base and into the desk or cabinet. The bracket may also be provided with one or more slotted openings formed in the base for receiving fasteners such as fastening screws in order to provide for limited lateral repositioning of the base relative to the desk or cabinet upon loosening the fastening screws.

To provide for lateral adjustment of a drawer carried by the drawer guide with respect to the desk or cabinet, appropriate adjustable features of the bracket of the present invention limit lateral movement of the received tongue portion of the drawer guide, the drawer guide, and the carried drawer. The retaining flanges, which are configured as resilient snap-in spring flanges, partially retain the snapped-in drawer guide tongue portion by frictional force to maintain the tongue portion in a fixed relationship with the bracket until a predetermined amount of force is exerted to readjust the relationship between the bracket and the tongue portion. If lateral adjustment is not desired, a notch may be formed in one of the support walls to receive and engage an end portion of a flange of the drawer guide to prevent lateral movement of the installed drawer guide.

This outline focuses on the more important features of the invention in order that a detailed description which follows may be better understood and in order that the present contribution to the art may be better appreciated. There are, of course, additional features of the invention that will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and being carried out in various ways.

It is to be further understood that the phraseology and terminology employed herein are for the purpose of description and are not to be regarded as limiting. Those skilled in the art will appreciate that the conception upon which this disclosure is based may readily be utilized as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved snap-in mounting bracket for a desk or cabinet drawer and with a drawer guide having a tongue portion which has all of the advantages, and more, of prior art brackets and none of the disadvantages.

It is another object of the present invention to provide a new and improved design of the type described that is more reliable and functional than those presently available.

Yet another object of the present invention is to provide a mounting bracket of the type described that enables installation of the bracket in a desk or cabinet before attaching the drawer guide to the bracket and enables the tongue portion of a drawer guide to be received in snap-in engagement by the installed bracket for lateral adjustment.

Still another object of the present invention is to provide a mounting bracket of the type described that enables repeated preselected lateral adjustments to be made to the mounted drawer relative to the desk or cabinet and yet operate reliably and efficiently thereafter.

A further object of the present invention is to provide a bracket of the type described utilizing a rear wall limiting lateral movement of the drawer guide tongue portion.

A still further object of the present invention is to provide a bracket of the type described providing a notch for engaging a flange of the drawer guide to prevent lateral movement of the drawer guide.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
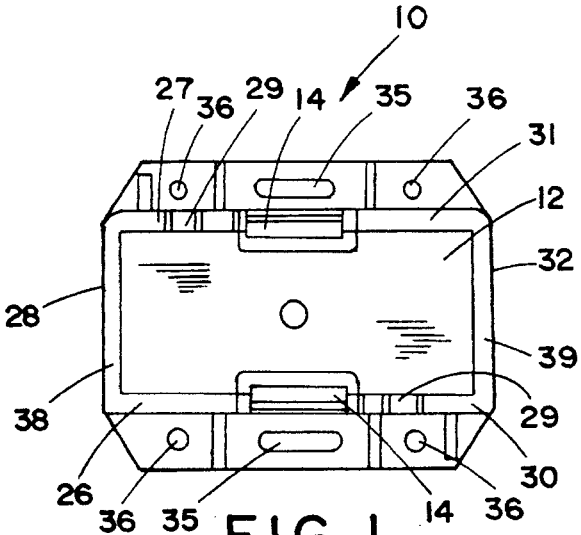
FIG. 1 is a plan view of the adjustable mounting bracket comprising the present invention.
Figure 2:
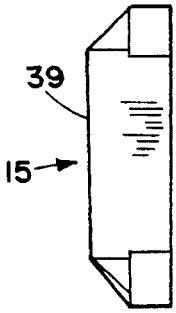
FIG. 2 is a front elevational view of the bracket shown in FIG. 1.
Figure 7:
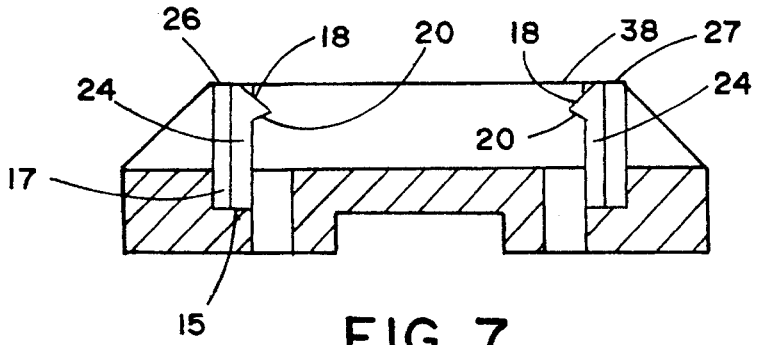
FIG. 7 is a sectional view of the bracket taken on the line 7—7 shown in FIG. 4.
Figure 8:
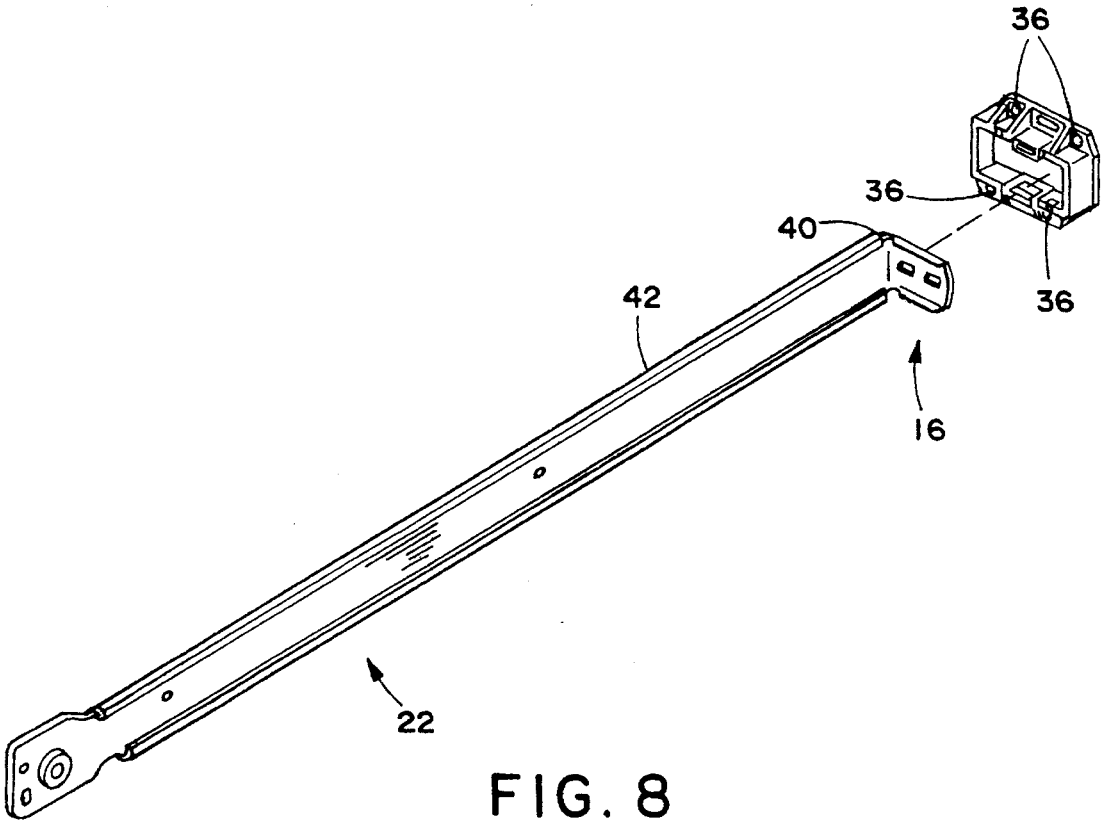
FIG. 8 is a perspective view of a drawer guide having a bent tongue portion cooperatively and adjustably received by the bracket shown in FIGS. 1 through 6.

Referring now to the drawings, and specifically to FIG. 1, an adjustable mounting bracket shown generally as 10 has a base 12 and opposing retaining flanges 14 resiliently connected to base 12 and configured to cooperatively receive (see arrow 15 in FIG. 2) the drawer guide tongue portion shown generally as 16 in FIG. 8 in snap-in engagement. Referring to FIG. 7, each retaining flange 14 has a sliding surface 18 and an associated engaging surface 20. Drawer guide tongue portion 16 is positioned flat against respective sliding surfaces 18 and, with pressure exerted on drawer guide tongue portion 16 in the direction of arrow 15 in FIG. 2, sliding surfaces 18, which are inclined relative to base 12, slidingly receive drawer guide tongue portion 16, deflecting retaining flanges 14 apart to enable tongue portion 16 to snap into an engaged position of tongue portion 16 between base 12 and engaging surfaces 20.

Opposing retaining flanges 14 are configured to hold tongue portion 16 in position against lateral movement without the exertion of a predetermined lateral force on the drawer guide shown generally as 22 in FIG. 8. Each of retaining flanges 14 has an upstanding section 24 carried by base 12, each of sliding surfaces 18 is inclined downwardly from the top of upstanding section 24 towards base 12, each of engaging surfaces 20 is inclined downwardly from sliding surface 18 toward upstanding section 24, and each of engaging surfaces 20 defines between them and base 12 a drawer guide tongue portion opening which is smaller than the thickness of drawer guide tongue portion 16. The tongue portion openings cooperatively receive drawer guide tongue portion 16 and frictionally maintain tongue portion 16 therein for lateral adjustment such that a predetermined lateral force is required to laterally reposition mounted drawer guide 22. Lateral movement of tongue portion 16 may be limited by one or both of a rear wall 38 upstanding from the rear 28 of base 12 and a front wall 39 upstanding from front 32 of base 12.

At least one support wall 26, or preferably, a pair of opposing support walls 26 and 27 are rigidly connected to base 12 and disposed between retaining flanges 14 and the rear 28 of base 12 to support snapped-in drawer guide tongue portion 16. Further support for snapped-in tongue portion 16 can be furnished by another support wall 30, or preferably, a second pair of opposing support walls 30 and 31, likewise rigidly connected to base 12 and disposed between retaining flanges 14 and the front 32 of base 12. The thickness of support walls 26, 27, 30 and 31 may be greater than the thickness of upstanding section 24 of retaining flanges 14, which must be dimensioned to be elastically deflectable to enable the tongue portion to be snapped in. For additional elasticity, the height of upstanding sections 24 of retaining flanges 14 may be increased by extending upwardly from ledge 15 formed in recess 17 defined in base 12.

Figure 5:
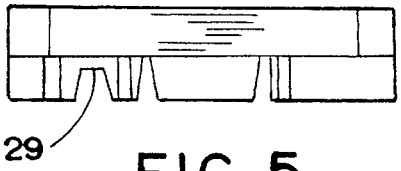
FIG. 5 is an elevational view of the opposite side of the bracket shown in FIG. 4.
Figure 3:
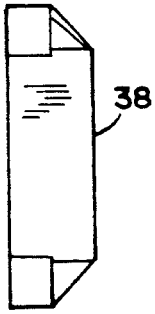
FIG. 3 is a rear elevational view of the bracket shown in FIGS. 1 and 2.
Figure 4:
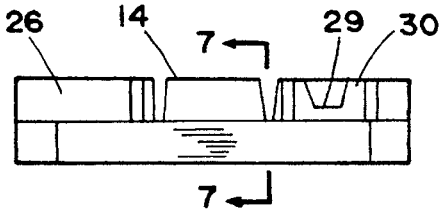
FIG. 4 is a side elevational view of the bracket shown in FIGS. 1 through 3.
Figure 6:
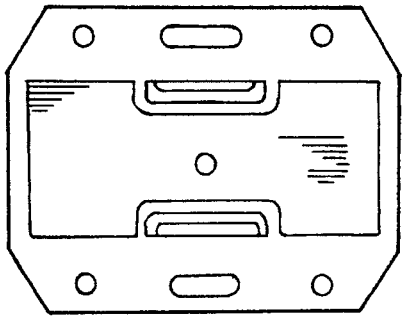
FIG. 6 is a bottom view of the bracket shown in FIGS. 1 through 5.

Alternatively, either of support walls 26, 27 disposed between retaining flanges 14 and rear 28 of base 12, and preferably support wall 27 as shown in FIGS. 1 and 5, may be provided with a notch 29 for receiving an end portion 40 of flange 42 of drawer guide 22, in which case, when drawer guide tongue portion 16 is installed in a snap-in engaged position between base 12 and respective engaging surfaces 20 of retaining flanges 14, end portion 40 of flange 42 is locked in position against lateral movement of drawer guide tongue portion 16. Likewise, to accommodate either right hand or left hand installation of drawer guide tongue portion 16, a corresponding notch 29 may be formed in either of support walls 30, 31 disposed between retaining flanges 14 and front 32 of base 12, and preferably in support wall 30 as shown in FIGS. 1 and 4, for the identical purpose.

Bracket base 12 is supported on a furniture article such as a desk or cabinet by one or more mechanical fasteners such as nails, braids or preferably fastening screws received through one or more openings 36 formed in bracket base 12 and into the desk or cabinet. The bracket may also be provided with one or more slotted openings 35 formed in base 12 for receiving fasteners such as fastening screws in order to provide for limited lateral repositioning of base 12 relative to the desk or cabinet upon loosening the fasteners.

It has been found that the device forming the present invention is economical to construct in that it can be provided in a one piece construction and that it is not necessary to premount bracket 10 on drawer guide tongue portion 16 before installing drawer guide 22 in a desk or cabinet. Instead, bracket 10 can be first attached to a desk or cabinet and drawer guide tongue portion 16 can then be snapped into bracket 10.

The bracket of the present invention may be used with a double captive drawer guide system which includes a drawer guide having a top flange which curves around the top of the roller of a drawer side rail and the drawer side rail having a top flange which curves around the top of the roller of the drawer guide. The drawer side rail roller cannot be disengaged from the drawer guide, and the drawer guide roller cannot be disengaged from the drawer side rail by lateral force applied to the drawer. Thus, a lateral force applied to the installed drawer laterally repositions both drawer guides relative to the bracket mounted on the desk or cabinet at the same time.

If lateral adjustment is not deemed necessary or desireable, a notch 29 may be formed in support wall 27 to receive and engage an end portion 17 of the top flange of drawer guide 22 to prevent lateral movement of the installed drawer guide relative to the bracket mounted on the desk or cabinet.

Obviously, any number of materials may be used to form the bracket and its components described herein, and exceptional success has been experienced by the use of semirigid plastic material for the bracket, although other materials may be utilized.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and change will readily occur to those skilled in the art, it is not intended to limit the invention to the exact construction and operation shown and described, and all suitable modifications and equivalents falling within the scope of the appended claims are deemed within the present inventive concept.

What is claimed is:

1. A snap-in mounting bracket for use in a furniture article and with a drawer guide having a flange and a tongue portion, the bracket comprising: a base; opposing retaining flanges carried by the base, each of the retaining flanges being resiliently connected to the base and each having a projection, the projections being normally spaced from one another by a distance for retaining said drawer guide tongue portion and being deflectable away from one another to define a gap between the projections for cooperatively receiving the drawer guide tongue portion through the gap between the projections and for snap-in engagement of the drawer guide tongue portion between the retaining flanges; means for supporting said base on the furniture article; and means carried by said base for supporting said engaged drawer guide tongue portion, said base having a front and a rear, and said drawer guide tongue support means comprising at least one support wall rigidly connected to said base and disposed between one of said retaining flanges and the rear of said base for supporting said engaged drawer guide tongue portion, and said support wall having portions defining a notch for receiving and engaging the flange of said drawer guide preventing lateral movement of the drawer guide.

2. The bracket as claimed in claim 1, said tongue portion support means further comprising a pair of said support walls opposing one another and rigidly connected to said base and disposed between said retaining flanges and the rear of said base for cooperatively supporting said engaged drawer guide tongue portion.

3. The bracket as claimed in claim 2, said drawer guide tongue portion support means further comprising a second pair of opposing support walls rigidly connected to said base and disposed between said retaining flanges and the front of said base for cooperatively supporting said engaged drawer guide tongue portion.

4. The bracket as claimed in claim 3, said base support means comprising at least one opening formed in said base for receiving a fastening screw through said base and into said furniture article.

5. The bracket as claimed in claim 4, each of said projections having a sliding surface and an associated engaging surface, said respective sliding surfaces being adapted for slidingly receiving said drawer guide tongue portion to a snapped-in engaged position of said drawer guide tongue portion between said base and said respective engaging surfaces.

6. A snap-in bracket and drawer guide assembly for use in a furniture article, comprising: a drawer guide having a tongue portion with a predetermined width; a base; opposing retaining flanges carried by the base, each of the retaining flanges being resiliently connected to the base and each having a projection, the projections being normally spaced from one another by a distance which is less than said width of the drawer guide tongue portion; said projections being deflectable away from one another to define a gap between the projections at least as great as said width of the drawer guide tongue portion and cooperatively receiving the drawer guide tongue portion through the gap between the projections in snap-in engagement of the drawer guide tongue portion between the retaining flanges; and means for supporting the base on said furniture article.

* * * * *